US009561917B2

(12) United States Patent
Morizono et al.

(10) Patent No.: US 9,561,917 B2
(45) Date of Patent: Feb. 7, 2017

(54) SHEET FEEDING DEVICE AND IMAGE FORMING APPARATUS

(71) Applicant: KYOCERA Document Solutions Inc., Osaka (JP)

(72) Inventors: Koki Morizono, Osaka (JP); Masuo Kawamoto, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/041,513

(22) Filed: Feb. 11, 2016

(65) Prior Publication Data

US 2016/0244281 A1 Aug. 25, 2016

(30) Foreign Application Priority Data

Feb. 19, 2015 (JP) ..... 2015-030752

(51) Int. Cl.
*B65H 1/00* (2006.01)
*B65H 1/04* (2006.01)
*B65H 1/14* (2006.01)

(52) U.S. Cl.
CPC *B65H 1/04* (2013.01); *B65H 1/14* (2013.01); *B65H 2403/533* (2013.01); *B65H 2405/1122* (2013.01); *B65H 2511/11* (2013.01); *B65H 2511/152* (2013.01); *B65H 2511/20* (2013.01); *B65H 2511/212* (2013.01); *B65H 2511/22* (2013.01)

(58) Field of Classification Search
CPC ..... B65H 2511/12; B65H 2701/1131; B65H 1/00; B65H 2405/00; B65H 2405/1116; B65H 2405/112; B65H 2405/113;B65H 2405/114; B65H 2405/251; B65H 1/10; B65H 1/022; B65H 1/025; B65H 1/08; B65H 1/04; B65H 1/26; B65H 1/263; B65H 1/30
See application file for complete search history.

(56) References Cited

U.S. PATENT DOCUMENTS 5,863,038 A * 1/1999 Zoltner ..... B65H 1/08 271/127
5,884,136 A * 3/1999 Takei ..... B41J 2/43 271/127

FOREIGN PATENT DOCUMENTS

JP 62-56237 * 3/1987
JP H09-142674 A 6/1997

* cited by examiner

*Primary Examiner* — Thomas Morrison
(74) *Attorney, Agent, or Firm* — Studebaker & Brackett PC

(57) ABSTRACT

A sheet feeding device includes a lifting plate, a pickup roller, a lifting and lowering mechanism of the lifting plate and an end cursor. The end cursor has a cursor main body and a turning cursor plate. The turning cursor plate is coupled to the cursor main body turnably around a turning shaft extending in a width direction orthogonal to the conveying direction and slidably along a lifting and lowering direction of the lifting plate. The turning cursor plate is configured to be turned toward the downstream side in the conveying direction around the turning shaft by being pushed up with the lifting of the lifting plate while the turning shaft is moved upward so that the sheet is shifted toward the downstream side along an upper surface of the lifting plate with respect to the lifting plate.

9 Claims, 7 Drawing Sheets

SHEET FEEDING DEVICE AND IMAGE FORMING APPARATUS

INCORPORATION BY REFERENCE

This application is based on and claims the benefit of priority from Japanese Patent application No. 2015-030752 filed on Feb. 19, 2015, the entire contents of which are incorporated herein by reference.

BACKGROUND

The present disclosure relates to a sheet feeding device which feeds a sheet on which an image is to be formed and an image forming apparatus including the sheet feeding device.

An image forming apparatus is provided with a sheet feeding device which feeds sheets stacked on a sheet feeding cartridge to an image forming part by a pickup roller. The pickup roller is disposed above the sheet feeding cartridge and is configured to abut against a front end portion of the uppermost sheet and feed the sheets from the uppermost sheet. In order for the pickup roller to abut against the uppermost sheet even if the amount of the stacked sheets decreases, there is known a sheet feeding device provided with a lifting plate on which the sheets are stacked. The lifting plate is configured to be inclined upward around its upstream side end in the conveying direction.

In such a sheet feeding device, an inclination angle of the lifting plate varies dependent on the amount of the stacked sheets on the lifting plate. For example, in a case where the sheets are fully stacked, the lifting plate hardly inclines; in the case of a last sheet, the inclination angle increases.

On the other hand, the sheet feeding cartridge is provided with an end cursor which abut against a rear edge of the sheets to restrain a length direction of the sheets. As shown in FIG. 7, the end cursor 101 is provided slidably in the conveying direction in an upright standing posture with respect to a bottom plate 102*a* of the sheet feeding cartridge 102 so as to be adjusted to the size of the sheets.

However, if the end cursor 101 is always in the upright standing posture with respect to the bottom plate 102*a* of the sheet feeding cartridge 102, in a case where the amount of the stacked sheets decreases and then the lifting plate 103 is inclined, a distance L1 along an upper surface of the lifting plate 103 between a downstream side surface 101*a* of the end cursor 101 in the conveying direction and an abutment position P of the pickup roller with the uppermost sheet becomes longer in comparison with the corresponding distance L2 in a case where the lifting plate 103 is not inclined. Thus, as indicated by the solid line of FIG. 7, if the sheets S are fully stacked, the pickup roller abuts against the uppermost sheet S1 at a suitable abutment position P. However, if the lifting plate 103 is inclined, as indicated by the double-dotted chain line of FIG. 7, a sheet S2 stacked on the lifting plate 103 shifts backward on the lifting plate 103 by a distance d toward the end cursor 101 side, that is, toward the upstream side in the conveying direction. Then, the downstream side end of the sheet S2 in the conveying direction does not reach the suitable abutment position P with the pickup roller.

Thus, if the downstream side end of the sheet in the conveying direction does not reach the suitable abutment position P with pickup roller, a failure, such as an overlapped feeding of the sheet, may easily occur. This failure occurs significantly for a small size sheet, a high rigid sheet such as a card, a high smoothness sheet or the like. Also, since the abutment position of the pickup roller and the sheet varies depending on when the sheets are fully stacked or when a small amount of sheets is stacked, even if a sheet can be fed normally, there may occur a problem such that the sheet feeding interval increase and thus an image is not formed at an suitable position on the sheet.

Accordingly, in order to solve such a problem, there is a sheet feeding device provided with the end cursor having an arc-shaped part at a lower end portion on a sheet side surface. In the sheet feeding device, even if an inclination angle of the lifting plate varies, the rear edge of the sheet abuts against the arc-shaped part so as to be pushed toward the upstream side in the conveying direction.

However, in this sheet feeding device, since the rear edge of the sheet may not abut against the arc-shaped part depending on the rigidity of the sheet and the stacking condition of the sheets, it is not impossible to shift the sheet to the suitable abutment position with the pickup roller surely. Therefore, a stable sheet feeding performance which does not cause a conveying fault, such as the overlapped feeding, cannot be obtained even if the amount of stacked sheets decreases.

SUMMARY

In accordance with an embodiment of the present disclosure, a sheet feeding device includes a lifting plate, a pickup roller, a lifting and lowering mechanism and an end cursor. The lifting plate on which sheets are to be stacked is provided in a sheet feeding cartridge. The pickup roller is configured to feed the sheet to a conveying path. The lifting and lowering mechanism is configured to turn the lifting plate with its upstream side end in a conveying direction as a turning point so as to lift and lower its downstream side end in the conveying direction with respect to the pickup roller. The end cursor is configured to be movable along the conveying direction and to abut against an upstream side edge of the sheet in the conveying direction so as to align the sheet in the conveying direction. The end cursor has a cursor main body and a turning cursor plate. The turning cursor plate is coupled to the cursor main body turnably around a turning shaft extending in a width direction orthogonal to the conveying direction and slidably along a lifting and lowering direction of the lifting plate. The turning cursor plate is configured to be turned toward the downstream side in the conveying direction around the turning shaft by being pushed up with the lifting of the lifting plate while the turning shaft is moved upward so that the sheet is shifted toward the downstream side along an upper surface of the lifting plate with respect to the lifting plate.

In accordance with an embodiment of the present disclosure, an image forming apparatus includes the above described sheet feeding device.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Hereinafter, with reference to figures, a sheet conveying device and an image forming apparatus according to the present discloser be described.

Figure 1:
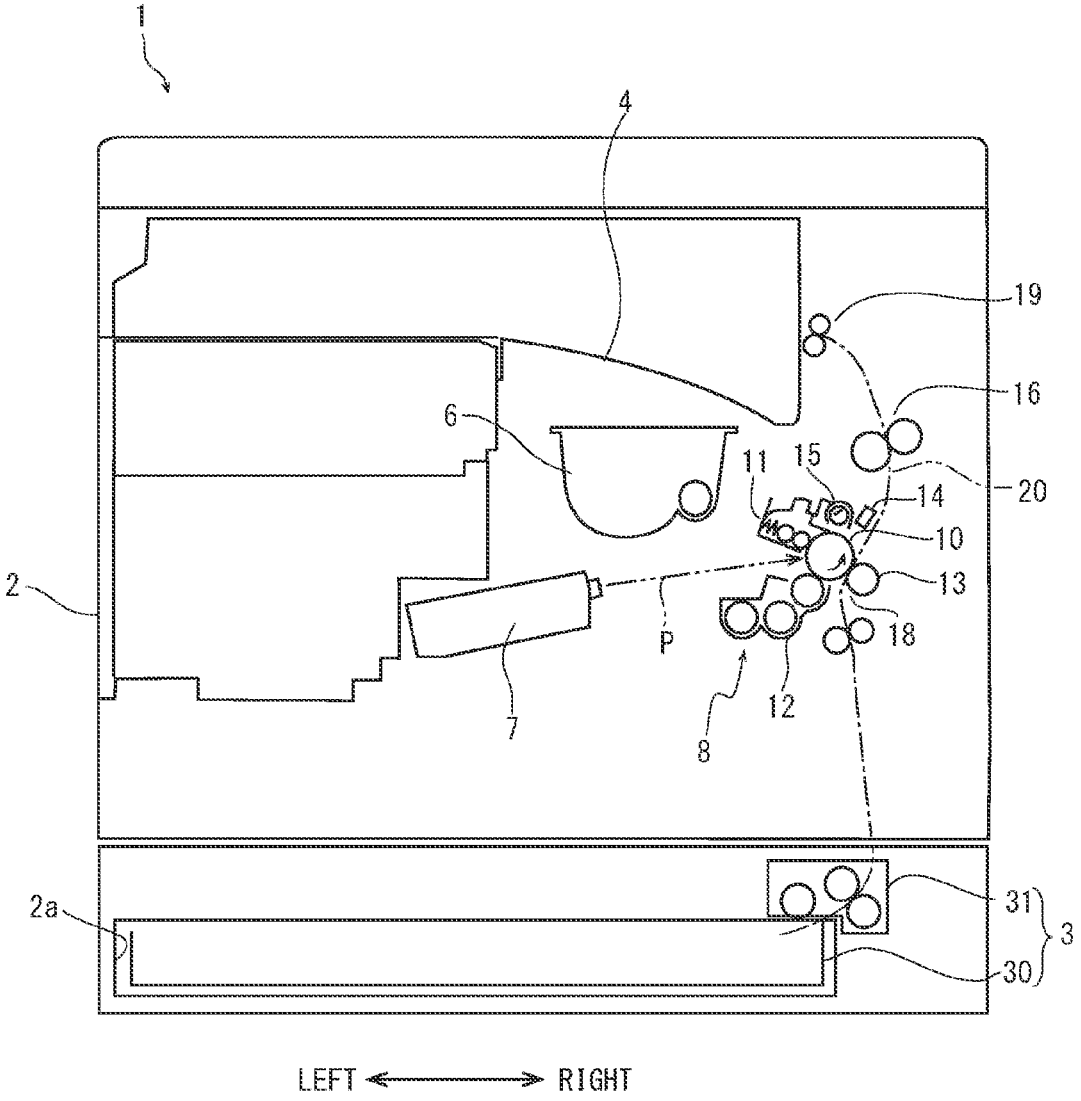
FIG. 1 is a schematic view showing an outline of a printer according to an embodiment of the present disclosure.

First, with reference to FIG. 1, an entire structure of a printer (an image forming apparatus) 1 will be described. FIG. 1 is a sectional view schematically showing the printer according to an embodiment of the present disclosure. Hereinafter, a front side in FIG. 1 indicates a front side of the printer 1 and left and right directions are described on the basis of a direction viewed the image forming apparatus 1 from the front side.

The printer 1 includes a box-shaped printer main body 2 provided with a front opening 2*a* at a lower portion. Inside the front opening 2*a*, a sheet feeding device 3 configured to feed a sheet (not shown) is provided. At an upper portion of the printer main body 2, an ejected sheet tray 4 is provided. Inside the printer main body 2, a toner container 6 storing toner is arranged and an exposure device 7 consisting of laser scanning unit (LSU) is arranged under the toner container 6. On a right side of the exposure device 7, an image forming part 8 is provided. The image forming part 8 includes a photosensitive drum 10 provided rotatably. Around the photosensitive drum 10, a charging device 11, a development device 12, a transfer roller 13, a cleaning device 14 and a static eliminator 15 are arranged in order along a rotating direction (refer to an arrow X in FIG. 1) of the photosensitive drum 10. Above the image forming part 9, a fixing part 16 is provided and a sheet ejecting part 19 is provided above the fixing part 16.

Inside the printer maim body 2, a conveying path 20 is formed extending from the sheet feeding device 3 toward the sheet ejecting part 19 through a transferring part 18 formed between the photosensitive drum 10 and the transferring roller 13 and the fixing part 16. Hereinafter, a direction along the conveying path 20 is defined as a sheet conveying direction.

Next, an image forming operation of the printer 1 having the above structure will be described. When image data is input from a computer or the like connected to the printer 1, image forming operation is carried out as follows.

First, the surface of the photosensitive drum 10 is electric-charged by the charging device 11. Then, photographic exposure corresponding to the image data on the photosensitive drum 10 is carried out by a laser light (refer to a two-dot chain line p in FIG. 1) from the exposure device 7, thereby forming an electrostatic latent image on the surface of the photosensitive drum 10. Subsequently, the electrostatic latent image is developed into a toner image by the development device 12.

On the other hand, the sheet fed by the sheet feeding device 3 is conveyed to the transferring part 18 in a suitable timing for the above-mentioned image forming operation, and then, the toner image on the photosensitive drum 10 is transferred onto the sheet at the transferring part 18. The sheet with the transferred toner image is conveyed to the downstream side along the conveying path 20 and goes into the fixing part 16, and then, the toner image is fixed on the sheet at the fixing part 16. The sheet with the fixed toner image is ejected from the sheet ejecting part 19 on the ejected sheet tray 4. The residual charge on the photosensitive drum 10 is eliminated by the static eliminator 14 and the residual toner on the photosensitive drum 10 is collected by the cleaning device 15.

Figure 2:
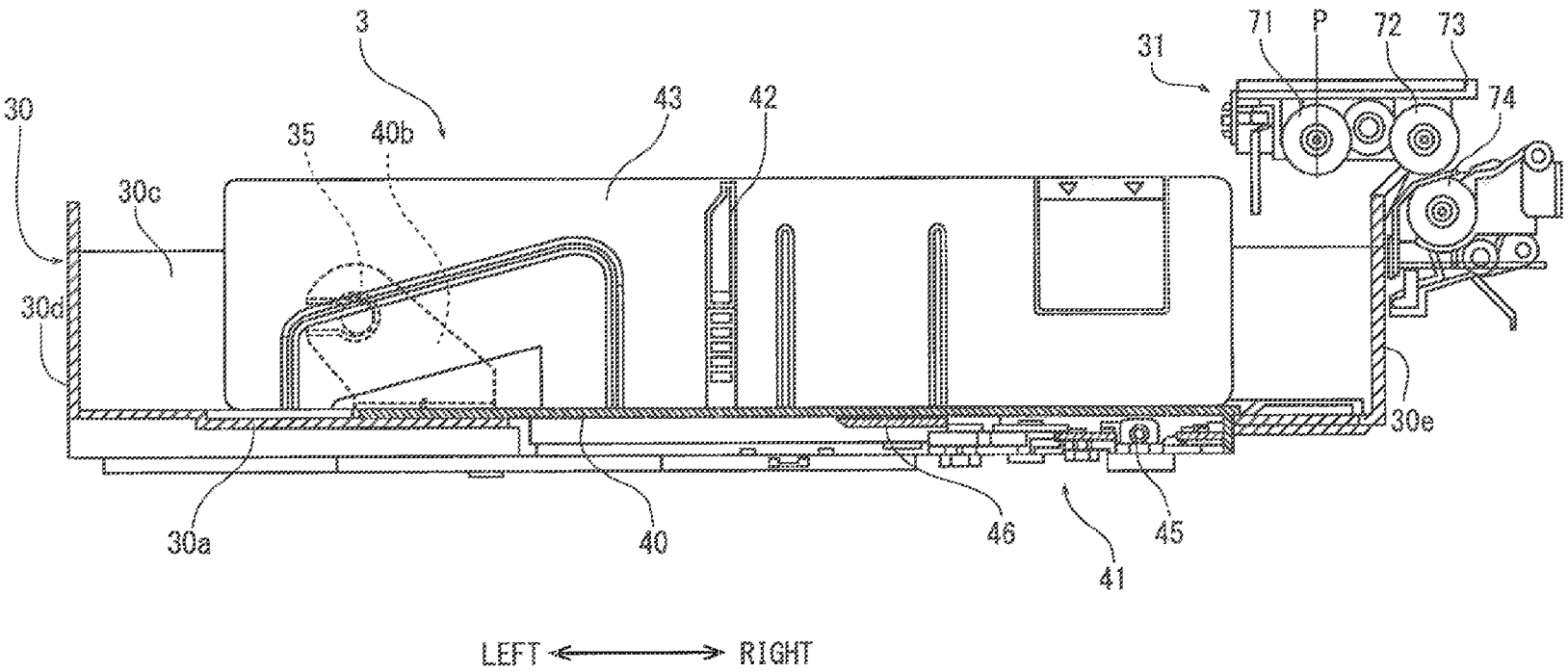
FIG. 2 is a front view showing an outline of a sheet feeding device in the printer according to the embodiment of the present disclosure.
Figure 3:
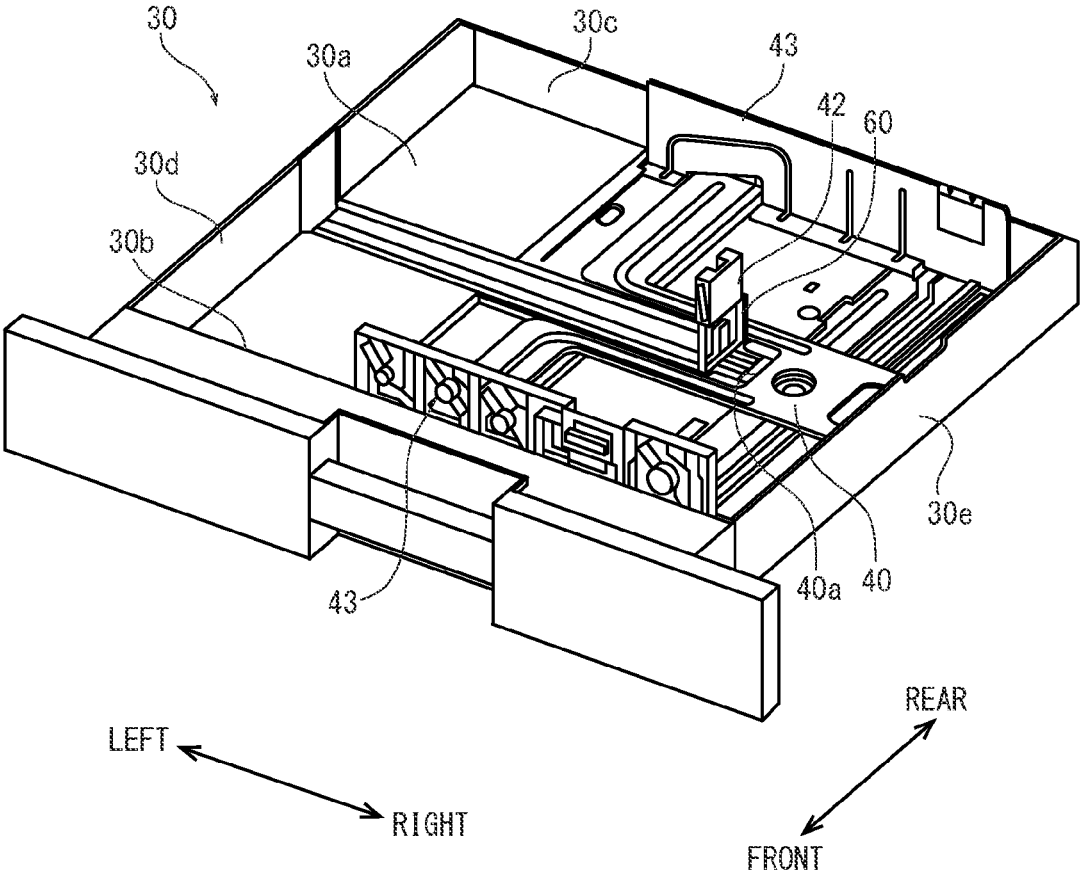
FIG. 3 is a perspective view showing a sheet feeding cartridge in the sheet feeding device according to the embodiment of the present disclosure.
Figure 4A:
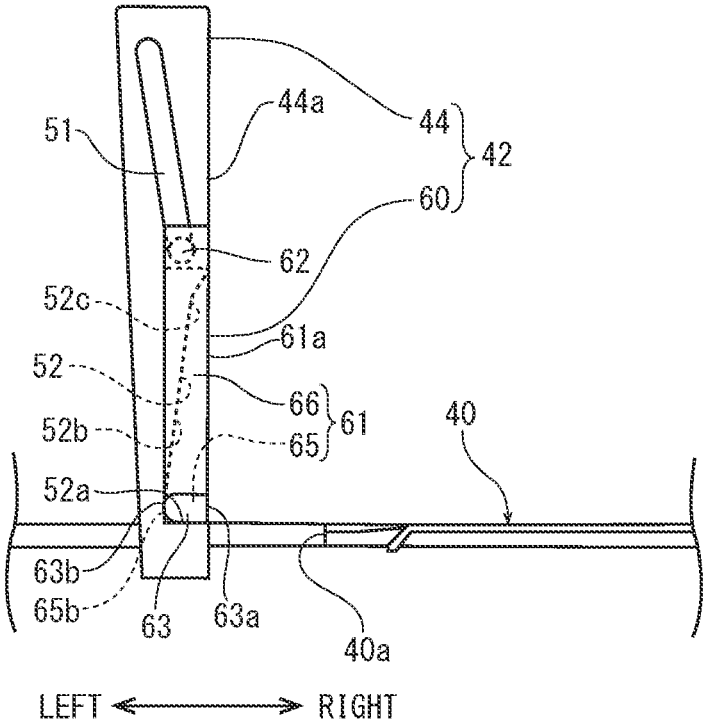
FIG. 4A is a front view showing an end cursor in a state in which a lifting plate is not inclined, in the sheet feeding device according to the embodiment of the present disclosure.
Figure 4B:
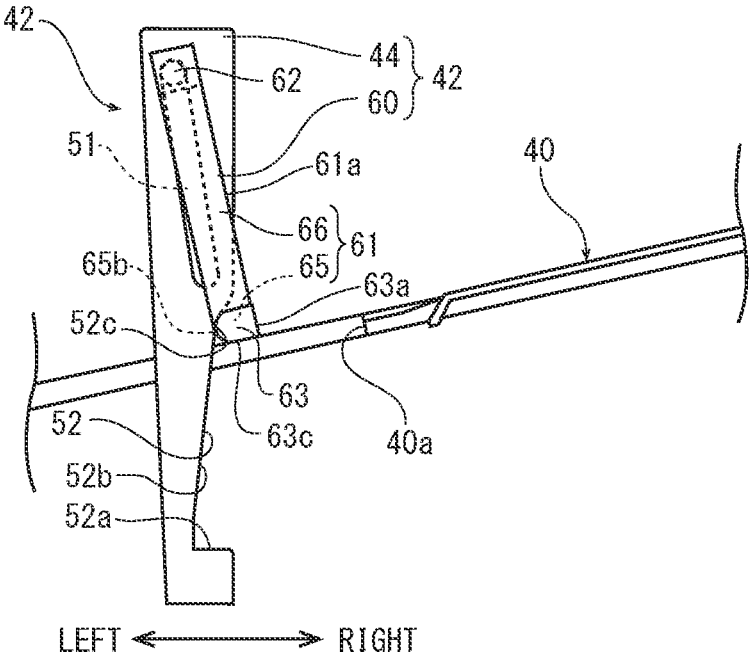
FIG. 4B is a front view showing the end cursor in a state in which the lifting plate is inclined, in the sheet feeding device according to the embodiment of the present disclosure.
Figure 5A:
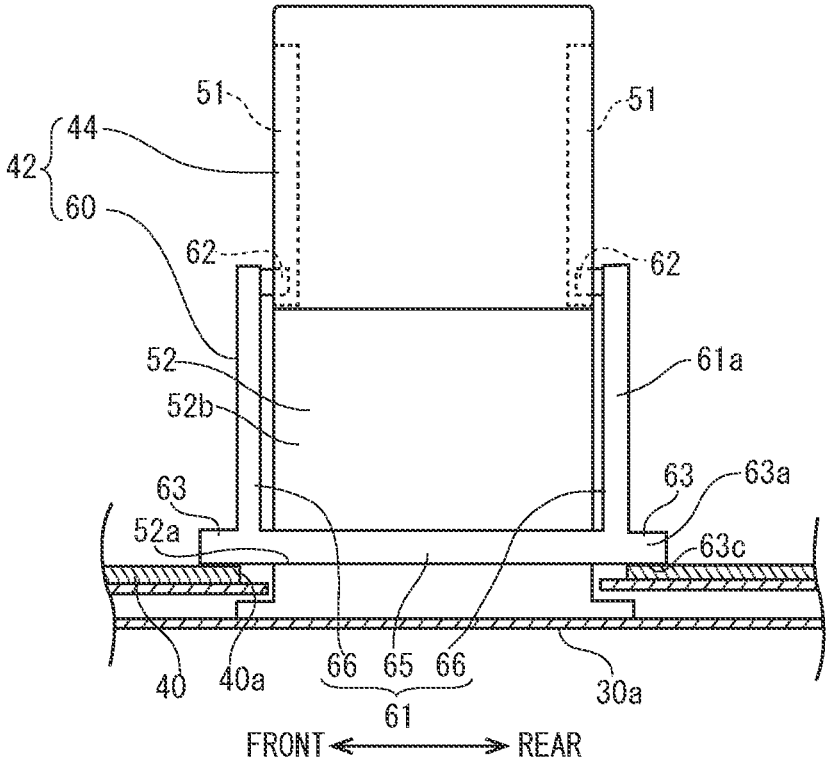
FIG. 5A is a side view showing the end cursor in a state in which the lifting plate is not inclined, in the sheet feeding device according to the embodiment of the present disclosure.
Figure 5B:
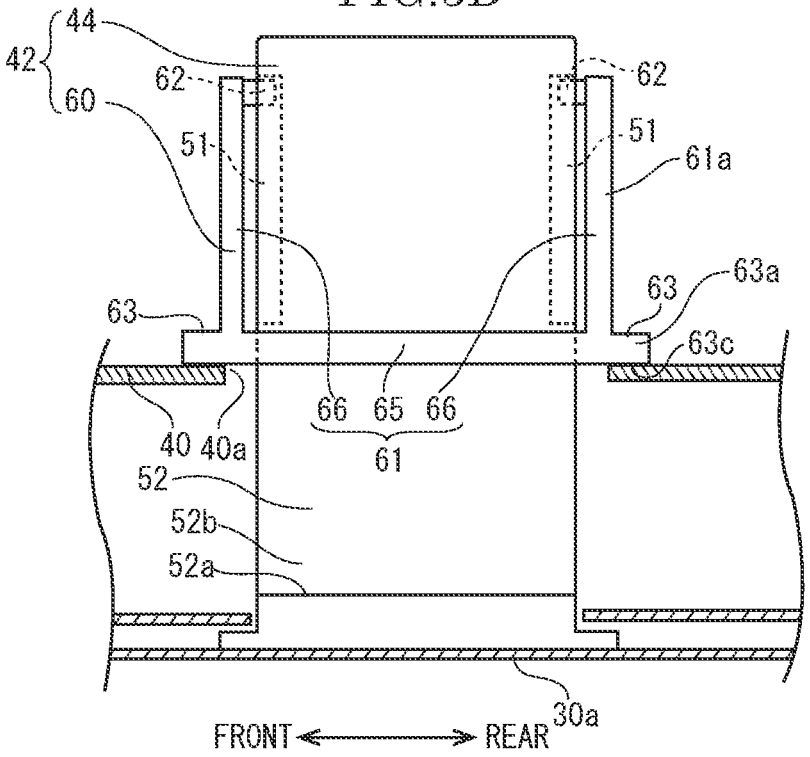
FIG. 5B is a side view showing the end cursor in a state in which the lifting plate is inclined, in the sheet feeding device according to the embodiment of the present disclosure.

Next, the sheet feeding device 3 will be described with reference to FIG. 2 to FIG. 5B. FIG. 2 is a front view showing an outline of the sheet feeding device; FIG. 3 is a perspective view showing a sheet feeding cartridge; FIG. 4A and FIG. 4B are front views showing an end cursor; and FIG. 5A and FIG. 5B are side views showing the end cursor, viewed from the right side. The sheet feeding device 3 includes a sheet feeding cartridge 30 on which sheets are to be stacked and housed and a sheet feeding and conveying unit 31 which feeds the sheet from the sheet feeding cartridge 30.

The sheet feeding cartridge 30, as shown in FIG. 2 and FIG. 3, is formed in a shallow box shape of which an upper surface is opened, and has a bottom plate 30*a*, front and rear side plates 30*b*, 30*c*, and left and right side plates 30*d*, 30*e*. The sheet feeding cartridge 30 is supported to the opening 2*a* of the printer main body 2 (refer to FIG. 1) drawably in the front and rear directions. On an inside surface of each of the front and rear side plates 30*b*, 30*c* of the sheet feeding cartridge 30, a pin 35 (refer to FIG. 2) protruding inward is coaxially formed.

The sheet feeding cartridge 30 is provided with a lifting plate 40 on which the sheets are to be stacked; a lifting and lowering mechanism 41 which turns the lifting plate 40 with its upstream side end portion in the conveying direction as a turning point to lift and lower its downstream side front portion in the conveying direction; an end cursor 42 which abuts against an upstream side edge of the sheet in the conveying direction and aligns the sheet in a sheet length direction; and a pair of side cursors 43 which abut against both end side edges of the sheet in a sheet width direction perpendicular to the conveying direction and align the sheet in the sheet width direction.

The lifting plate 40 is disposed on the bottom plate 30*a* of the sheet feeding cartridge 30. As shown in FIG. 3, at a center in the width direction of the lifting plate 40, a slit 40*a* is formed extending along the conveying direction from an upstream side edge in the conveying direction. Also, along the upstream side end portions in the conveying direction of front and rear side edges of the lifting plate 40, supporting pieces 40*b* (refer to FIG. 2) perpendicular to an upper surface of the lifting plate 40 are formed. Each supporting piece 40*b* engages with the pin 35 provided on each of the front and rear side plates 30*b*, 30*c* of the sheet feeding cartridge.

The lifting and lowering mechanism 41 is disposed under a right end portion (a downstream side end portion in the conveying direction) of the lifting plate 40, and has a turning plate 46 which turns around a driving shaft 45 in upward and downward directions. If the turning plate 46 turns in the clockwise direction of FIG. 2 around the driving shaft 45, the lifting plate 40 is lifted by the turning plate 46 and inclined around the pin 35.

The end cursor 42 is supported at the center portion in the width direction of the bottom plate 30*a* of the sheet feeding cartridge 30 slidably through the slit 40*a* of the lifting plate 40 in an upright standing posture with respect to the bottom plate 30*a*.

As shown in FIG. 4A to FIG. 5B, the end cursor 42 has a cursor main body 44 of vertically long rectangular shape and a turning cursor plate 60 coupled to the cursor main body 44. A right side surface (a downstream side surface in the conveying direction) 44*a* of the cursor main body 44 is formed to be perpendicular to the bottom plate 30*a* of the sheet feeding cartridge 30. Also, at a substantially upper half portion of each side surface of the cursor main body 44, an engaging groove 51 is formed. The engaging groove 51, as shown in FIG. 4, is formed in a substantially linear shape inclining obliquely upward toward the upstream side in the conveying direction (inclining in the left obliquely upward direction in a front view). This engaging groove 51 includes a tangent line or an arc of a circle around the pin 35 that is the turning point of the lifting plate 40.

Further, on the right side surface 44*a* of the cursor main body 44, an inclined guiding part 52 inclining in the vertical direction is formed under the engaging grooves 51. The inclined guiding part 52 has a horizontal bottom surface 52*a* and an oblique surface 52*b* inclining obliquely upward toward the right side (the downstream side in the conveying direction). The bottom surface 52*a* is formed so as to be on the same plane as the upper surface of the lifting plate 40 which is in a non-inclined posture. At a position close to an upper end of the oblique surface 52*b*, a bend part 52*c* bending at an obtuse angle is formed.

The turning cursor plate 60, as shown in FIG. 5A and FIG. 5B, is a U-shaped member viewed from the conveying direction, and has; a main body 61 abutting against the upstream side edge of the sheet in the conveying direction; turning shafts 62 coupled to the cursor main body 44; and a pair of protrusion parts 63 abutting on the upper surface of the lifting plate 40.

The main body 61 has a pair of arm parts 66 extending in the vertical direction and a connecting part 65 which connects lower ends of the pair of arm parts 66. A right side surface 61*a* (a downstream side surface in the conveying direction) of the main body 61 is formed to be flat. A left side surface 65*b* (an upstream side surface of the conveying direction) of the connecting part 65 is formed in a convex arc shape protruding leftward.

The turning shafts 62 are formed at upper end portions of inside surfaces of the pair of arm parts 66 of the main body 61 and protrude coaxially in directions closing to each other.

The pair of protrusion parts 63 are formed at outside surfaces of the connecting part 65 of the main body 61 and protrude in opposite directions. A right side surface 63*a* of each protrusion parts 63 is formed to be flush with the right side surface 61*a* of the main body 61. A left side surface 63*b* of each protrusion parts 63 is formed in a convex arc shape protruding leftward, like the left side surface 65*b* of the connecting part 65. A bottom surface 63*c* of each protrusion parts 63 is formed to be flat perpendicular to the right side surface 63*a*.

The turning cursor plate 60 is coupled to the end cursor 42 by sandwiching the cursor main body 44 between the pair of arm parts 66 from the downstream side in the conveying direction and then engaging the turning shafts 62 with the respective engaging grooves 51 of the cursor main body 44. As shown in FIG. 4A and FIG. 5A, in a state in which the lifting plate 40 is not inclined, the turning cursor plate 60 is housed in the inclined guiding part 52 of the cursor main body 44 so that the right side surface 61*a* of the main body 61 is flush with the right side surface 44*a* of the cursor main body 44. Namely, in the main body 61, the pair of arm parts 66 are positioned outside of the front and rear side surfaces of the cursor main body 44, the left side surface 65*b* of the connecting part 65 abuts against the oblique surface 52*b* of the inclined guiding part 52 and the bottom surface of the connecting part 65 abuts against the bottom surface 52*a* of the inclined guiding part 52. In addition, the turning shafts 62 are positioned at the lowest portions of the respective engaging grooves 51 and the protrusion parts 63 protrude outward from the front and rear side surfaces of the cursor main body 44.

The pair of side cursors 43, as shown in FIG. 2 and FIG. 3, are disposed on the bottom plate 30*a* of the sheet feeding cartridge 30 on the both sides of the lifting plate 40. The pair of side cursors 43 are supported slidably so as to be close to or to be spaced away from each other synchronously with reference to the center of the width direction of the sheets.

The sheet feeding and conveying unit 31 is disposed at an upper right corner of the opening 2*a* (refer to FIG. 1) of the printer main body 2. The sheet feeding and conveying unit 31, as shown in FIG. 2, includes: a pickup roller 71 which abuts against the downstream side end portion of the sheet in the conveying direction and feeds the sheet; a sheet feeding roller 72 which conveys the fed sheet; a holder 73 which supports the pickup roller 71 and the sheet feeding roller 72; and a separating roller 74 which prevents the feeding of any sheet other than the uppermost sheet.

The pickup roller 71 and the sheet feeding roller 72 are supported to the holder 73 rotatably in the same direction with the pickup roller 71 on the upstream side in the conveying direction and the sheet feeding roller 72 on the downstream side. The holder 73 is configured to swing around a rotating shaft of the sheet feeding roller 72. If the lifting plate 40 is lifted and then the sheet stacked on the lifting plate 40 abuts against the pickup roller 71, the holder 73 turns around the rotating shaft of the sheet feeding roller 72. When the holder 73 turns until the pickup roller 71 reaches a sheet feeding position, the lifting of the lifting plate 40 is stopped. This makes it possible to keep the sheet feeding position always constant.

Figure 6:
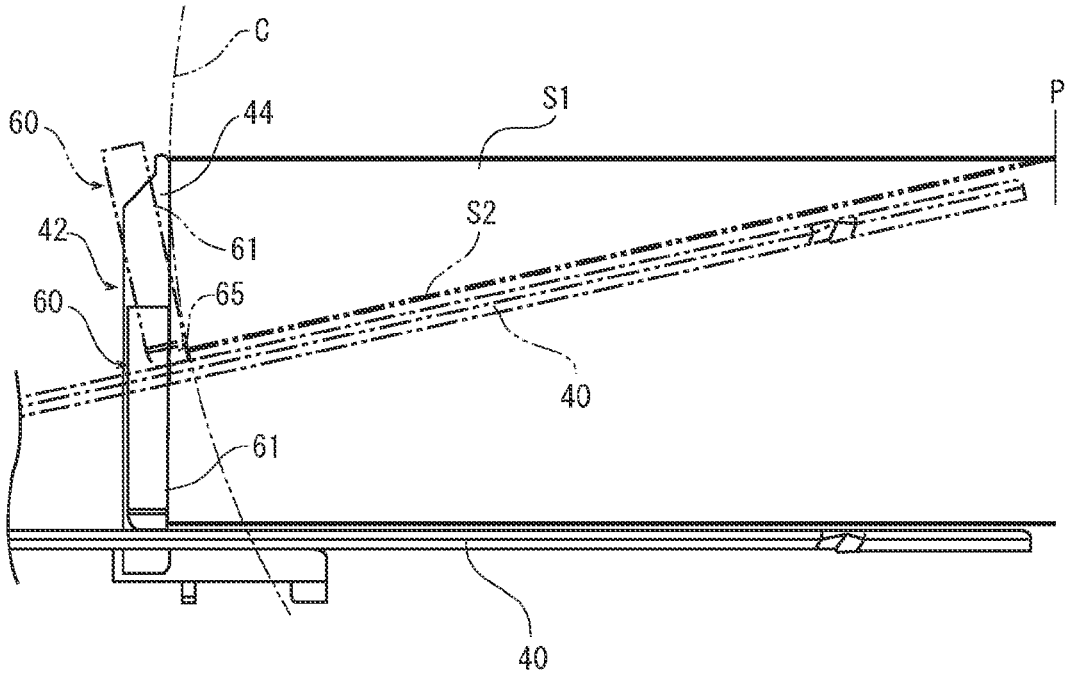
FIG. 6 is a front view showing a posture of a turning cursor plate when sheets are fully stacked and when a small amount of sheets are stacked, in the sheet feeding device according to the embodiment of the present disclosure.
Figure 7:
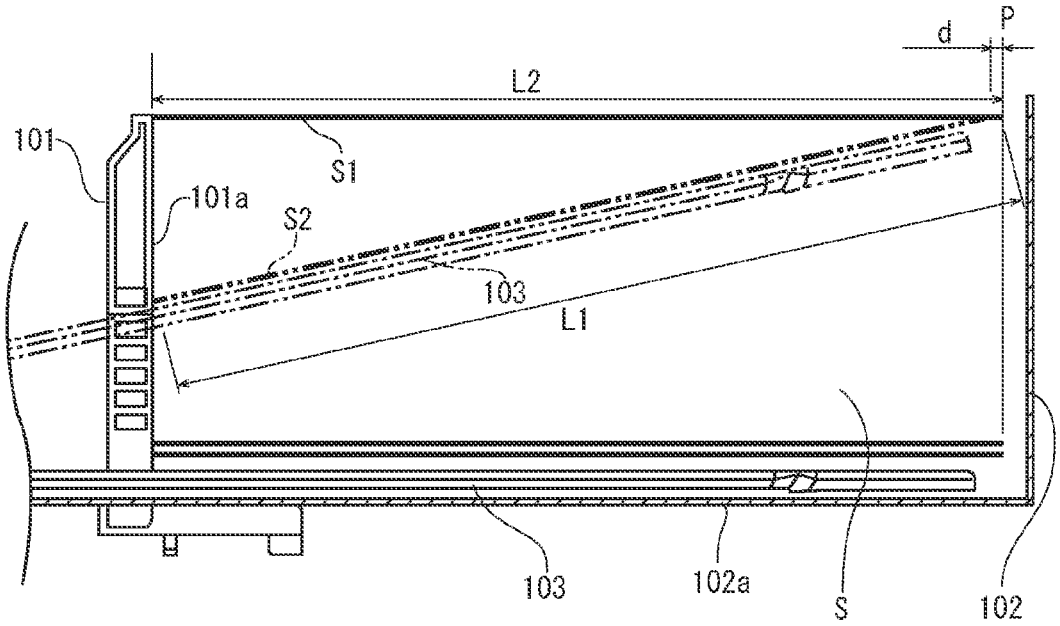
FIG.7 Related Art
FIG. 7 is a side view showing a positional relationship between the end cursor and the lifting plate, in a conventional sheet feeding device.

A feeding operation of sheet of small size in the sheet feeding device 3 having the above-described construction will be described with reference to FIG. 4 to FIG. 6 and the like. FIG. 6 is a front view showing a posture of the turning cursor plate when the sheets are fully stacked and when a small amount of sheets is stacked. When the sheets of small size are stacked on a predetermined stacking position of the lifting plate 40 in the sheet feeding cartridge 30, the end cursor 42 is slid in the downstream side in the conveying direction through the slit 40*a* of the lifting plate 40 so that the right side surface 44*a* of the cursor main body 44, the right side surface 61*a* of the main body 61 and the right side surface 63*a* of each protrusion parts 63 of the turning cursor plate 60 are abutted against the upstream side edges of the sheets in the conveying direction. This aligns the sheets in the conveying direction. At this juncture, the bottom surfaces 63*c* of the protrusion parts 63 of the turning cursor plate 60 abut on the upper surface of the lifting plate 40 on each side edge of the slit 40*a* in the width direction.

Further, the pair of side cursors 43 are slid so as to abut against both side edges of the stacked sheets in the width direction and to align the sheets in the width direction. Then, the uppermost sheet S1 of the stacked sheets is fed to a nip between the sheet feeding roller 72 and the separating roller 74 by the pickup roller 71 of the sheet feeding and conveying unit 31 at the sheet feeding position P.

If an amount of the sheets in the sheet feeding cartridge 30 becomes small, the turning plate 46 is turned in the clockwise direction of FIG. 2 around the driving shaft 45 by the lifting and lowering mechanism 41 (refer to FIG. 2). In this manner, the lifting plate 40 is lifted by the turning plate 46 and turned in the counterclockwise direction of FIG. 2 around the pin 35. The lifting plate 40 is inclined upward toward the downstream side in the sheet feeding direction so that the uppermost sheet S2 abuts against the pickup roller 71.

When the lifting plate 40 is inclined, the turning cursor plate 60 is pushed up with respect to the cursor main body 44 by the protrusion parts 63 that is abutting on the upper surface of the lifting plate 40 on both sides of the slit 40*a*. During the pushing up of the turning cursor plate 60, the main body 61 is turned in the counterclockwise direction of FIG. 4A around the turning shafts 62 which are moved upward along the engaging grooves 51 while tuning. And, the left side surface 65*b* of the connecting part 65 is guided along the oblique surface 52*b* of the inclined guiding part 52 obliquely upward toward the downstream side in the conveying direction. Then, as shown in FIG. 4B and FIG. 5B, the connecting part 65 is moved toward the downstream side along the upper surface of the lifting plate 40 together with the protrusion parts 63 in an upright standing posture perpendicular to the upper surface of the lifting plate 40.

When the connecting part 65 of the turning cursor plate 60 is moved toward the downstream side along the upper surface of the lifting plate 40, the turning cursor plate 60 shifts the sheet S2 toward the downstream side with respect to the lifting plate 40. In FIG. 6, when the lifting plate 40 is filled with the sheets, the upstream side edge of the uppermost sheet S1 abuts against the cursor main body 44 at an abutment position A1. When only one sheet S2 is remained on the lifting plate 40, the lifting plate 40 is inclined at a maximum inclinable angle. At this time, the upstream side edge of the sheet S2 abuts against the turning cursor plate 60 at an abutment position A2. Since the turning cursor plate 60 is configured to turn in the upright standing posture to the upper surface of the lifting plate 40, the abutment position A2 is positioned on a circle C of which a radius is a sheet length with the sheet feeding position P as a center, as well the abutment position A1. Therefore, even if the lifting plate 40 is inclined, the downstream side edge of the sheet S2 in the conveying direction is always positioned at the sheet feeding position P. Alternatively, an interval between the downstream side edge of the sheet S2 in the conveying direction and the sheet feeding position P becomes very small. Accordingly, irrespective of the inclination of the lifting plate 40, it becomes possible to abut the pickup roller 71 against the sheet S2 at the sheet feeding position P. Incidentally, in a state in which the lifting plate 40 is inclined up at an maximum inclinable angle (refer to FIG. 4B and FIG. 5B), the turning shafts 62 of the turning cursor plate 60 reach near upper ends of the engaging grooves 51 and the connecting part 65 of the main body 61 reaches the bend part 52*c* of the inclined guiding part 52. Incidentally, in the state in which the lifting plate 40 is inclined up at the maximum inclinable angle, since the turning shafts 62 do not abut against the upper end surfaces of the engaging grooves 51, damage to the turning cursor plate 60 or the cursor main body 44 can be prevented.

If a sheet is replenished to the sheet feeding cartridge 30, the lifting plate 40 is lowered. With the lowering of the lifting plate 40, the turning cursor plate 60 is also lowered by its own weight and is turned in the clockwise direction of FIG. 4 around the turning shafts 62 which move downward along the respective engaging grooves 51. The main body 61 is guided downward along the inclined guiding part 52 of the cursor main body 44. Then, the turning cursor plate 60 is lowered with the protrusion parts 63 abutting on the upper surface of the lifting plate 40 and then the main body 61 is housed in the inclined guiding part 52.

As described above, in the sheet feeding device 3 according to the embodiment of the present disclosure, since the turning cursor plate 60 turns in the upright standing posture perpendicular to the lifting plate 40, even if the lifting plate 40 is inclined, the sheet S2 stacked on the lifting plate 40 can be shifted toward the downstream side with respect to the lifting plate 40. Therefore, irrespective of the inclination of the lifting plate 40, that is, irrespective of the amount of stacked sheets, the sheet can be always abutted against the pickup roller 71 at the sheet feeding position P properly. Accordingly, in particular, even if the amount of stacked sheets of small size becomes small, the sheet can be appropriately fed without an occurrence of a conveying fault, such as an overlapped feeding or variation of sheet feeding intervals.

In addition, it is only required to couple the turning cursor plate 60 interlocking with the lifting plate 40 to the cursor main body 44 of the end cursor 42 that is conventionally provide, therefore achieving a simple construction.

Further, during the lifting and lowering of the lifting plate 40, since the turning cursor plate 60 turns in the upright standing posture perpendicular to the upper surface of the lifting plate 40, it becomes possible to move the turning shafts 62 upward and downward along the respective engaging grooves 51 stably. Furthermore, the turning cursor plate 60 can support the stacked sheets without any displacement and stably shift the stacked sheets to the sheet feeding position P.

Still furthermore, when the main body 61 of the turning cursor plate 60 is guided along the inclined guiding part 52 with the lifting and lowering of the lifting plate 40, since the arc-shaped left side surface 65*b* of the connecting part 65 of the main body 61 comes in contact with the oblique surface 52*b* of the inclined guiding part 52, the main body 61 is smoothly moved along the inclined guiding part 52.

Incidentally, although the embodiment was described as to the case in which the turning cursor plate 60 is lowered by its own weight at the time of lowering of the lifting plate 40, the turning cursor plate 60 may be lowered by using a biasing member such as a spring.

The embodiment was described in a case of applying the configuration of the present disclosure to the color printer 1. On the other hand, in another embodiment, the configuration of the disclosure may be applied to another image forming apparatus, such as a copying machine, a facsimile or a multifunction peripheral, except for the printer 1.

While the preferable embodiment and its modified example of the sheet feeding device and the image forming apparatus of the present disclosure have been described above and various technically preferable configurations have been illustrated, a technical range of the disclosure is not to be restricted by the description and illustration of the embodiment. Further, the components in the embodiment of the disclosure may be suitably replaced with other components, or variously combined with the other components. The claims are not restricted by the description of the embodiment of the disclosure as mentioned above.

What is claimed is:

1. A sheet feeding device comprising:

a lifting plate on which sheets are to be stacked, in a sheet feeding cartridge;

a pickup roller configured to feed the sheets in a conveying direction to a conveying path;

a lifting and lowering mechanism configured to turn the lifting plate with its upstream side end in the conveying direction as a turning point so as to lift and lower its downstream side end in the conveying direction with respect to the pickup roller; and an end cursor configured to be movable along the conveying direction and to abut against an upstream side edge of the sheets in the conveying direction so as to align the sheets in the conveying direction, wherein the end cursor includes:

a cursor main body; and a turning cursor plate coupled to the cursor main body turnably around a turning shaft extending in a width direction orthogonal to the conveying direction and slidably along a lifting and lowering direction of the lifting plate, and wherein the turning cursor plate is configured to be turned toward the downstream side end in the conveying direction around the turning shaft by being pushed up with the lifting of the lifting plate while the turning shaft is moved upward so that at least one of the sheets is shifted toward the downstream side end along an upper surface of the lifting plate with respect to the lifting plate, wherein while the turning cursor plate is turned toward the downstream side end around the turning shaft by being pushed up with the lifting of the lifting plate, a lower end portion of the turning cursor plate moves in a downstream direction along the upper surface of the lifting plate so that the turning cursor plate is always kept in an upright standing posture perpendicular to the upper surface of the lifting plate.

2. The sheet feeding device according to claim 1, wherein the cursor main body has:

an inclined guiding part provided on a lower portion of its downstream side surface, the inclined guiding part being inclined upward toward a downstream side, and a pair of engaging grooves provided on both side surfaces in the width direction above the inclined guiding part, the pair of engaging grooves being inclined upward toward an upstream side, and wherein the turning cursor plate has:

a pair of arm parts extending in a vertical direction and provided with a downstream side surface abutting against the upstream side edge of the sheets;

a connecting part configured to connect lower ends of the pair of arm parts and provided with a downstream side surface abutting against the upstream side edge of the of sheets and an upstream side surface abutting against the inclined guiding part, and a pair of protrusion parts protruding outward in the width direction from the lower ends of the pair of arm parts, the pair of protrusion parts abutting on the upper surface of the lifting plate, wherein the turning shaft includes a pair of turning shafts with each of the turning shafts protruding inward in the width direction from an upper end portion of one of the pair of arm parts and slidably engaging with one of the pair of engaging grooves, and wherein when the lifting plate is lifted, the pair of protrusion parts are pushed up by the lifting plate, the pair of turning shafts move upward along the engaging grooves while turning, the connecting part is guided by the inclined guiding part while being turned around the pair of turning shafts, and the pair of protrusion parts slide toward the downstream side end on the upper surface of the lifting plate so that the turning cursor plate shifts the at least one of the sheets toward the downstream side end with respect to the lifting plate.

3. The sheet feeding device according to claim 2, wherein the lifting plate has a slit extending from the upstream side end toward the downstream side end, and the pair of protrusion parts of the turning cursor plate abut on the upper surface of the lifting plate at both side edges in the width direction of the slit.

4. The sheet feeding device according to claim 2, wherein the downstream side surface of the connecting part and a bottom surface of each of the pair of protrusion parts are formed to be perpendicular to each other.

5. The sheet feeding device according to claim 2, wherein an upstream side surface of the connecting part is formed into a sectional convex arc shape.

6. The sheet feeding device according to claim 2, wherein the engaging grooves have a length larger than a maximum moving length of the pair of turning shafts and wherein when the lifting plate is inclined at a maximum inclinable angle, the pair of turning shafts do not abut against upper end surfaces of the pair of engaging grooves.

7. An image forming apparatus comprising the sheet feeding device according to claim 1.

8. A sheet feeding device comprising:

a lifting plate on which sheets are to be stacked, in a sheet feeding cartridge;

a pickup roller configured to feed the sheets in a conveying direction to a conveying path;

a lifting and lowering mechanism configured to turn the lifting plate with its upstream side end in the conveying direction as a turning point so as to lift and lower its downstream side end in the conveying direction with respect to the pickup roller; and an end cursor configured to be movable along the conveying direction and to abut against an upstream side edge of the sheets in the conveying direction so as to align the sheets in the conveying direction, wherein the end cursor includes:

a cursor main body; and a turning cursor plate coupled to the cursor main body turnably around a turning shaft extending in a width direction orthogonal to the conveying direction and slidably along a lifting and lowering direction of the lifting plate, and wherein the turning cursor plate is configured to be turned toward the downstream side end in the conveying direction around the turning shaft by being pushed up with the lifting of the lifting plate while the turning shaft is moved upward so that at least one of the sheets is shifted toward the downstream side end along an upper surface of the lifting plate with respect to the lifting plate, wherein a downstream side surface of the cursor main body and downstream side surface of the turning cursor plate are configured to be flush with each other and perpendicular to the upper surface of the lifting plate when the lifting plate is turned into a horizontal posture.

9. A sheet feeding device comprising:

a lifting plate on which sheets are to be stacked, in a sheet feeding cartridge;

a pickup rover configured to feed the sheets in a conveying direction to a conveying path;

a lifting and lowering mechanism configured to turn the lifting plate with its upstream side end in the conveying direction as a turning point so as to lift and lower its downstream side end in the conveying direction with respect to the pickup roller; and an end cursor configured to be movable along the conveying direction and to abut against an upstream side edge of the sheets in the conveying direction so as to align the sheets in the conveying direction, wherein the end cursor includes:

a cursor main body; and a turning cursor plate coupled to the cursor main body turnably around a turning shaft extending in a width direction orthogonal to the conveying direction and slidably along a lifting and lowering direction of the lifting plate, and wherein the turning cursor plate is configured to be turned toward the downstream side end in the conveying direction around the turning shaft by being pushed up with the lifting of the lifting plate while the turning shaft is moved upward and to abut against the upstream side edge of the sheets in the conveying direction so that at least one of the sheets is shifted toward the downstream side end along an upper surface of the lifting plate.

* * * * *